US010448698B2

(12) United States Patent
Emmanuelli

(10) Patent No.: US 10,448,698 B2
(45) Date of Patent: Oct. 22, 2019

(54) PROTECTIVE SHOE COVER

(71) Applicant: Fabricio Emmanuelli, Winter Park, FL (US)

(72) Inventor: Fabricio Emmanuelli, Winter Park, FL (US)

( * ) Notice: Subject to any disclaimer, the term of this patent is extended or adjusted under 35 U.S.C. 154(b) by 0 days.

(21) Appl. No.: 15/432,499

(22) Filed: Feb. 14, 2017

(65) Prior Publication Data

US 2017/0273391 A1 Sep. 28, 2017

Related U.S. Application Data

(60) Provisional application No. 62/312,124, filed on Mar. 23, 2016.

(51) Int. Cl.

| | |
|---|---|
| ***A43B 3/16*** | (2006.01) |
| ***A43B 3/18*** | (2006.01) |
| ***A43B 3/20*** | (2006.01) |
| ***A43B 7/12*** | (2006.01) |
| ***A43B 1/00*** | (2006.01) |
| ***A43C 11/14*** | (2006.01) |

(52) U.S. Cl.

CPC ..... *A43B 7/12* (2013.01); *A43B 1/0081* (2013.01); *A43B 3/16* (2013.01); *A43B 3/18* (2013.01); *A43B 3/20* (2013.01); *A43C 11/1493* (2013.01)

(58) Field of Classification Search

CPC .. A43B 3/16; A43B 3/166; A43B 3/18; A43B 3/20

USPC ..... 36/7.1 R, 7.2, 106

See application file for complete search history.

(56) References Cited

U.S. PATENT DOCUMENTS

| | | | | | |
|---|---|---|---|---|---|
| 1,467,950 | A * | 9/1923 | Rauscher | A43B 3/16 | 36/7.3 |
| 3,497,875 | A * | 3/1970 | Rivera | A43B 3/16 | 2/239 |
| 4,665,633 | A * | 5/1987 | Edgerton | A43B 3/16 | 36/2 R |
| 5,845,416 | A * | 12/1998 | Hands | A43B 3/16 | 36/2 R |
| 5,950,333 | A * | 9/1999 | Tsen | A43B 5/18 | 36/127 |
| 5,987,778 | A * | 11/1999 | Stoner | A41D 17/00 | 36/1.5 |
| 8,490,302 | B2 * | 7/2013 | Rosin | A43B 5/08 | 36/103 |
| 2008/0229615 | A1 * | 9/2008 | Yu | A43B 3/20 | 36/100 |
| 2011/0072691 | A1 * | 3/2011 | Greer | A43B 3/16 | 36/72 R |
| 2012/0260536 | A1 * | 10/2012 | Espino Botello | A43B 3/16 | 36/72 R |

(Continued)

*Primary Examiner* — Sharon M Prange

(57) ABSTRACT

A protective shoe cover includes a shoe-shaped main body that is constructed from two complementary shaped sides that form a toe section, a heel section, and an ankle section which define a hollow interior space. Each of the two sides are removably secured together along the back end of the main body via a fastener which extends between the heel section and the ankle opening. A bottom opening is positioned along the bottom end of the main body for receiving the outsole of an inserted shoe, and a plurality of ledges extend along the bottom opening to engage the outsole and secure the same within the protective cover.

3 Claims, 5 Drawing Sheets

(56) References Cited

U.S. PATENT DOCUMENTS

| | | | | |
|---|---|---|---|---|
| 2013/0167409 | A1* | 7/2013 | Kann | A43B 3/20<br>36/72 R |
| 2015/0113831 | A1* | 4/2015 | Weingart | A43B 3/16<br>36/87 |
| 2016/0309832 | A1* | 10/2016 | Weaver | A43B 3/0078 |

* cited by examiner

PROTECTIVE SHOE COVER

CROSS-REFERENCE TO RELATED APPLICATIONS

This application claims the benefit of U.S. application Ser. No. 62/312,124 filed on Mar. 23, 2016, the contents of which are incorporated herein by reference.

TECHNICAL FIELD

The present invention relates generally to shoe accessories, and more particularly to a protective shoe and foot cover.

BACKGROUND

The statements in this section merely provide background information related to the present disclosure and may not constitute prior art.

Shoe covers are typically constructed from a lightweight flimsy netting material that is designed to encompass the entire foot and shoe of a wearer. These devices are typically worn in hospitals and other types of clean room settings, where the purpose of the cover is to prevent the flooring from being contaminated by shoes with dirt, mud and other such materials.

Although useful for this purpose, these shoe protectors do not provide any type of protection to the shoes themselves. As such, it is common for shoes to become damaged from everyday activities such as paint, chlorine, sawdust and the like, along with adverse natural conditions such as rain, snow, dirt and mud, for example.

Accordingly, the present invention is directed to a protective shoe cover that differs from the conventional art in a number of aspects. The manner by which will become more apparent in the description which follows, particularly when read in conjunction with the accompanying drawings.

SUMMARY OF THE INVENTION

The present invention is directed to a protective shoe cover. One embodiment of the present invention can include a shoe-shaped main body that is constructed from two complementary shaped sides to form a toe section, a heel section, and an ankle section that define a hollow interior space. Each of the two sides are removably secured together along the back end of the main body via a fastener which extends between the heel section and the ankle opening. The fastener can allow the sides to become separated when receiving a shoe into the hollow interior space.

In another embodiment, the main body can include a bottom opening for receiving the outsole of an inserted shoe. A plurality of ledges extend along the bottom opening to engage the outsole and secure the same within the protective cover.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
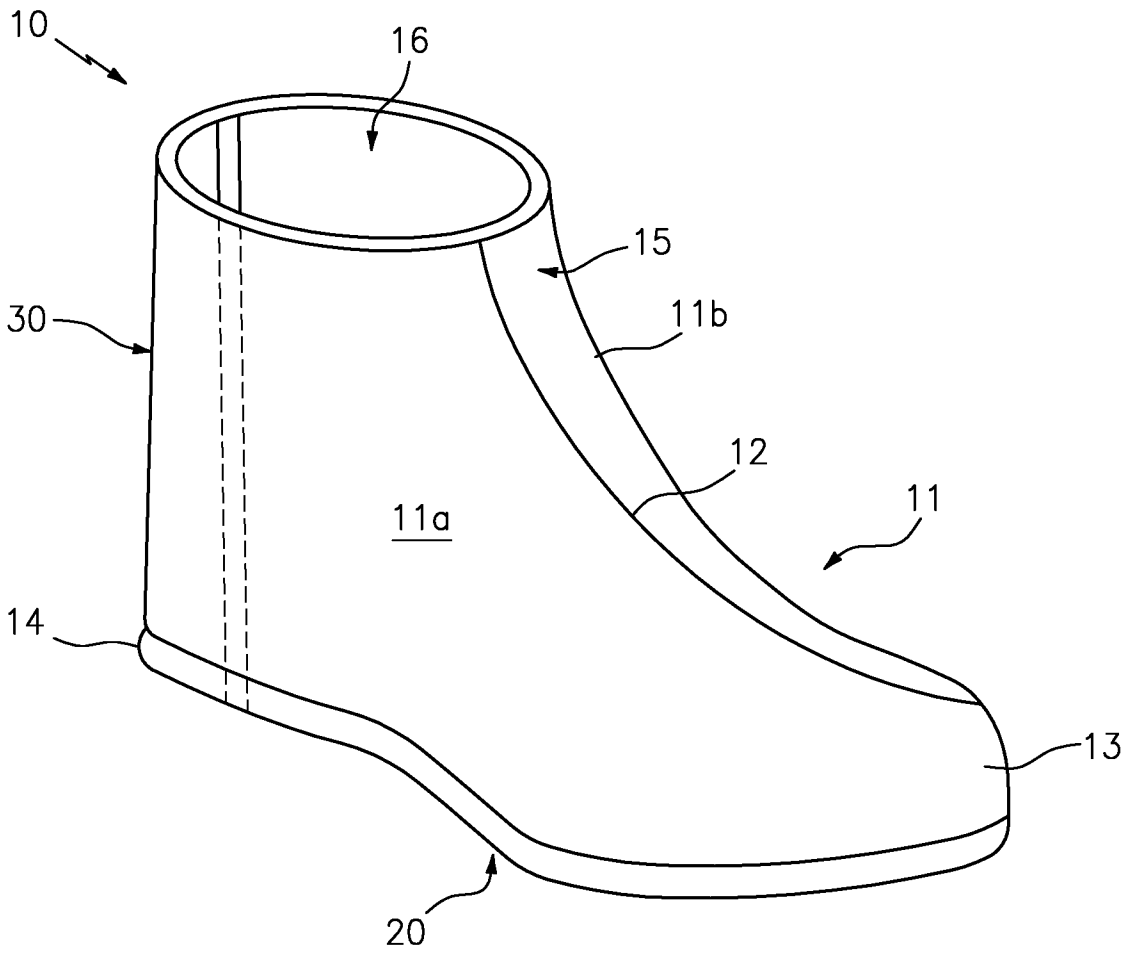
FIG. 1 is a perspective view of a protective shoe cover that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," "complementary dimension," and derivatives thereof shall be used to describe a shape and size of a component that is identical to, or substantially identical to the shape and size of another component. Likewise, the term "removably secured," and derivatives thereof shall be used to describe a situation wherein two or more objects are joined together in a non-permanent manner so as to allow the same objects to be repeatedly joined and separated.

FIGS. 1-5 illustrate one embodiment of a protective shoe cover 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown, the protective shoe cover 10 can include a main body 11 which conforms generally to the shape of a shoe. The main body can be constructed from two complementary shaped halves 11*a* and 11*b*, which are joined together by an elongated longitudinal seam 12. Each of the halves forming, a toe section 13, a heel section 14 and an ankle section 15 that define a hollow interior space. An opening 16 is positioned along the top end of the ankle section for receiving the leg and ankle of a user within the hollow interior space. Of course other embodiments are contemplated wherein the main body is constructed from a unitary piece of material.

The cover can preferably be constructed from a lightweight waterproof and generally resilient material such as silicone, latex or lycra, for example, and may be made as a left shoe cover, a right shoe cover, may be made to fit a specific size, or may be made as a universal fit shoe cover that is designed to stretch to fit several different sizes of shoes. Of course, any number of other materials are also contemplated.

Figure 2:
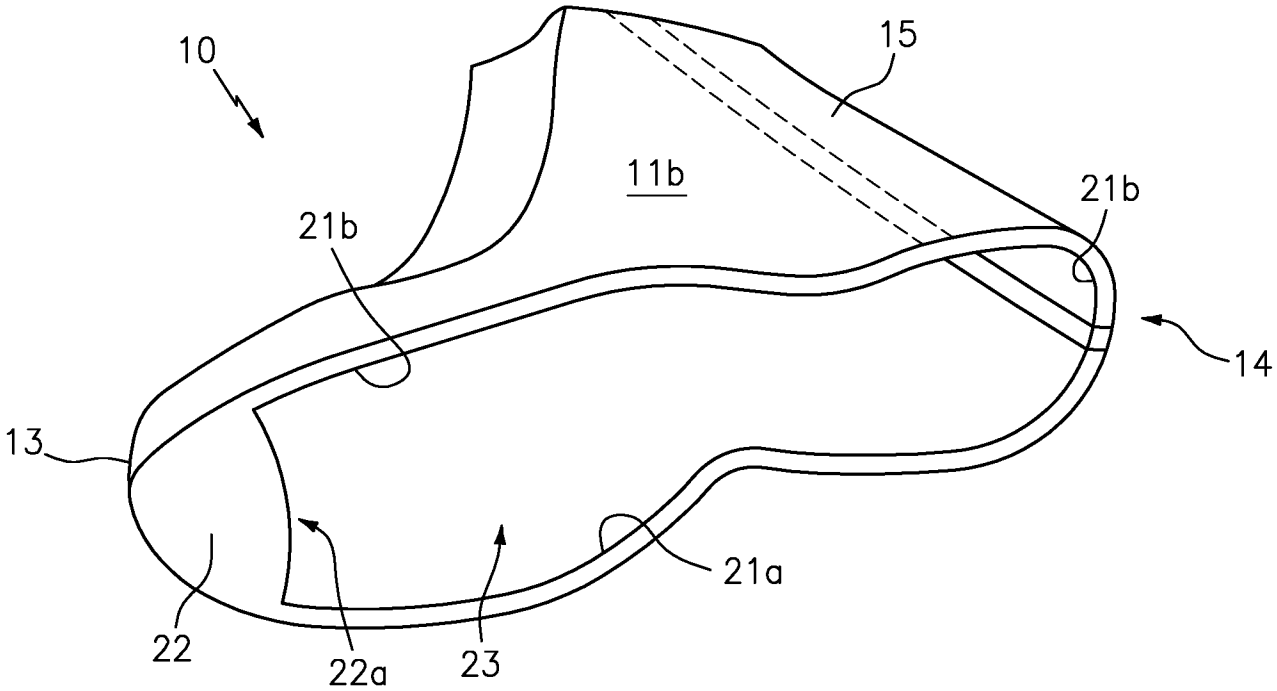
FIG. 2 is a bottom view of the protective shoe cover, in accordance with one embodiment of the invention.

As shown best in FIG. 2, the bottom end 20 of the shoe cover 10 can include inward facing ledges 21*a* and 21*b* that are formed along the bottom ends of the main body halves 11*a* and 11*b*. Likewise, an enlarged toe ledge 22 can be positioned beneath the toe section 13, and can extend toward the heel section of the cover. Each of the ledges 21*a*, 21*b* and 22 can function to define a bottom opening 23 having a shape and size that can engage the outsole of a shoe.

In the preferred embodiment, the toe ledge 22 can be between 2 and 5 times longer (e.g., distance extending inside the opening) than ledges 21*a* and 21*b*, so as to provide a capped area 22*a* for receiving and securing the toe section of an inserted shoe within the main body of the cover. Each of the ledges 21*a*, 21*b* and 22 can preferably be constructed from an elastomeric material, so as to allow the shape of the ledges to conform to the shape of the outer periphery of the inserted outsole. Moreover, it is preferred that the inside facing portion of the ledges include a high friction material such as rubber, for example, which can engage the outsole of an inserted shoe and prevent movement/sliding of the same against the ledge itself.

Figure 3:
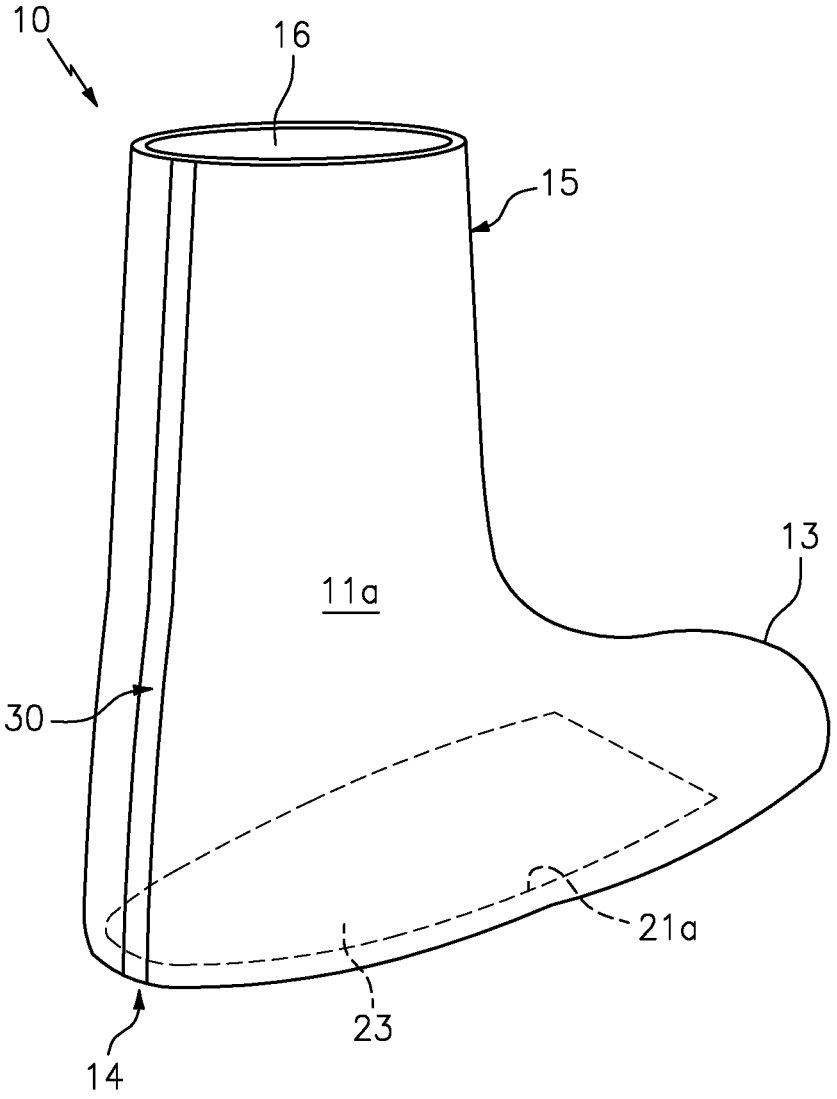
FIG. 3 is a back side view of the protective shoe cover, in accordance with one embodiment of the invention.

As shown in FIG. 3, the back end 30 of the shoe cover 10 can include an elongated fastener that extends from the heel portion 14 to the ankle opening 16. The fastener can function to selectively transition the shoe cover between the illustrated closed position, and the open position shown below at FIG. 4. As such, the fastener can preferably include opposing strips of hook and loop material (e.g., Velcro) 31*a* and 31*b* that are secured along the two halves 11*a* and 11*b*, respectively.

Of course, the fastener is not limited to the use of hook and loop material, as any number of known devices capable of securing two items together in a removable manner are also contemplated. Several nonlimiting examples include zippers, ties, tethers, magnetic elements, and compression fittings such as snaps and buttons, for example. Each of these items can be permanently secured to each of the two halves 11*a* and 11*b* via permanent sealers such as glue, adhesive tape, or stitching, for example.

Figure 4:
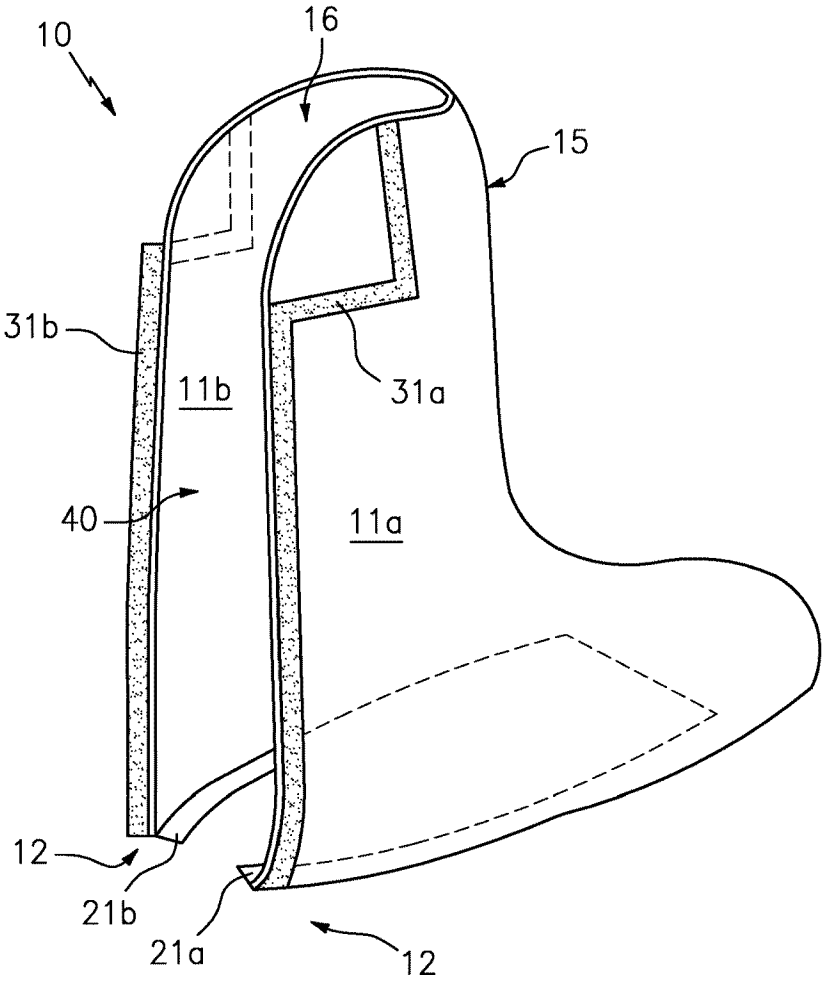
FIG. 4 is a perspective view of the protective shoe cover in operation, in accordance with one embodiment of the invention.
Figure 4:
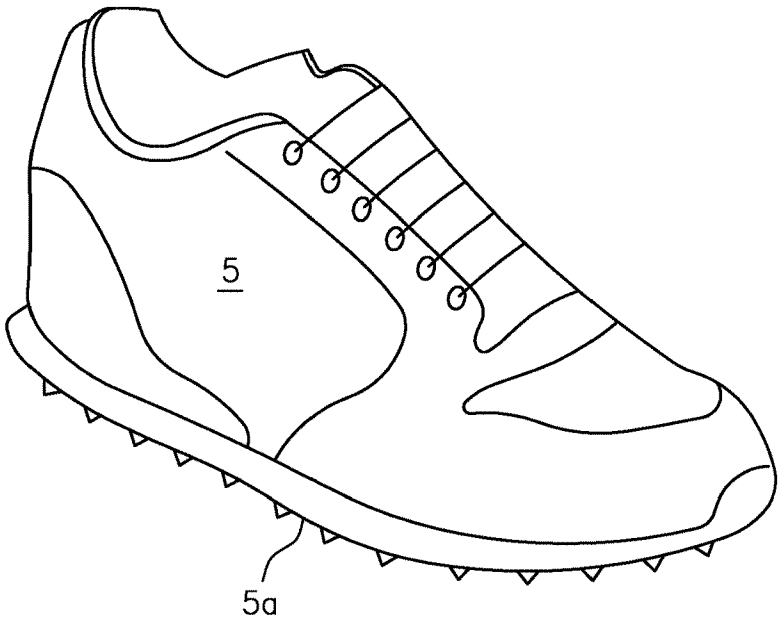
Figure 5:
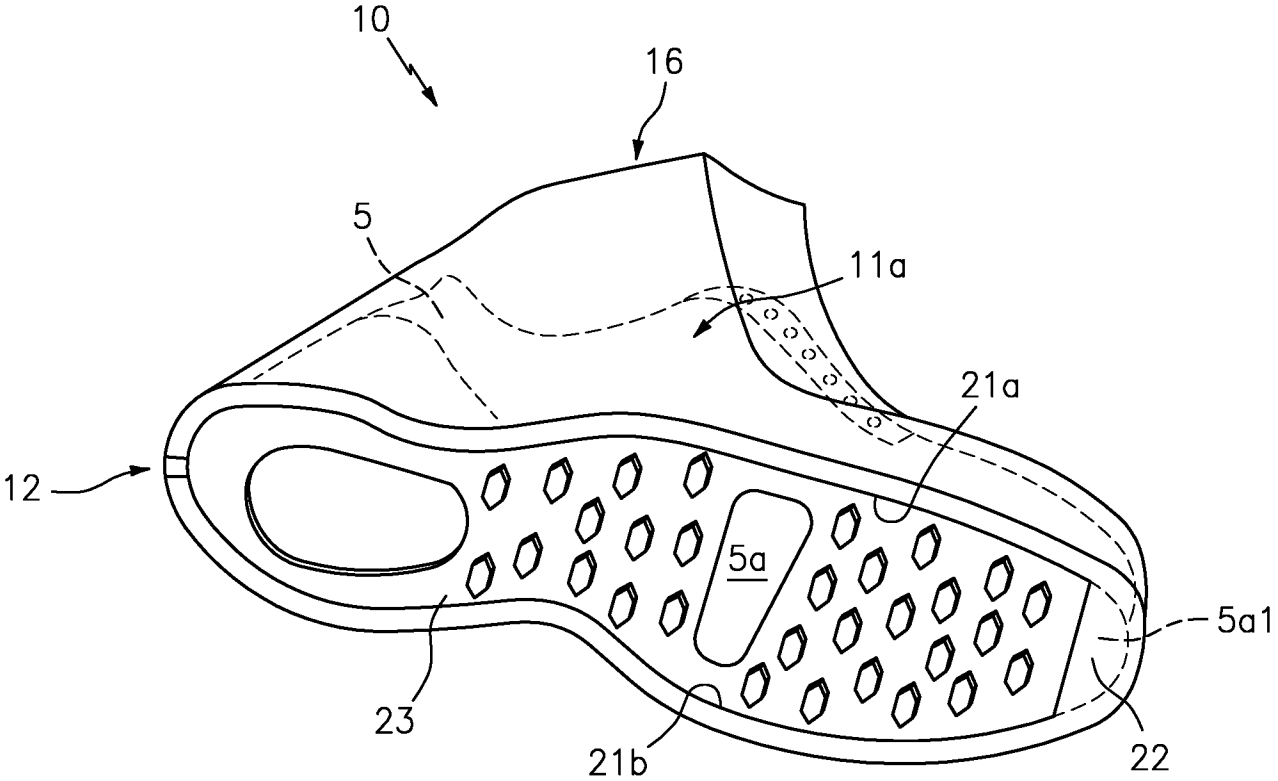
FIG. 5 is another perspective view of the protective shoe cover in operation, in accordance with one embodiment of the invention.

FIGS. 4 and 5 illustrate one embodiment of the device 10 in operation. As noted above, the protective shoe cover 10 can be designed to engage any type of conventional shoe 5 having an outsole 5*a* along the bottom end thereof. Several nonlimiting examples include running shoes, walking shoes, dress shoes, tennis shoes, boots, sandal's, flip flops and the like.

As such, the cover can be used by initially disengaging the fastener elements 31*a* and 31*b*, so as to allow the main body halves 11*a* and 11*b* to be separated. Next, a user can insert a shoe 5 into the opening 40 formed by the separation, until the tip of the outsole 5*a*1 is against the toe ledge 22. Finally, the user can pull the body halves 11*a* and 11*b* back together and tighten the cover 10 about the exterior of the inserted shoe 5 via the fastener elements.

When so positioned, the outsole 5*a* of the shoe will be positioned within and/or extend beyond the bottom of the bottom opening 23. Such a feature allows the shoe cover 10 to protect the visible upper portion of the shoe, without affecting the grip of the shoe on the ground. This is a particularly advantageous feature, as it allows the shoe cover 10 to be used with specialty shoes such as tap shoes or high grip construction shoes, for example, without affecting the functionality of the same.

Moreover, in some instances the ankle portion 15 may extend above the upper end of the shoe itself. When this occurs, the resilient nature of the main body, along with the flexibility of the fastener allows the user to size the upper opening 16 to fit about their ankle or calf. Such a feature advantageously prevents rain and other materials from seeping onto the foot and/or socks of the user when the shoe cover is being worn.

Although not illustrated, the main body 11 can also include any number and type of decorative elements such as various colors, markings, words, shapes, symbols, logos, designs, lights, types of materials, texturing of materials, patterns, images, photographs and/or jewels, for example. These elements can be secured onto and/or into the main body in accordance with known techniques so as to be flush with the surface of the main body or can be recessed, raised and/or protruding outward from the main body so as to give a three dimensional effect.

Accordingly, the presently claimed invention provides a novel approach for protecting shoes of any type and size without affecting the operation of the shoe itself.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A protective shoe cover, comprising:

a shoe-shaped main body having a pair of complementary shaped sides, a toe section, a heel section, and an ankle section that define a generally hollow interior space;

wherein the shoe-shaped main body is constructed from a unitary piece of material, and wherein the shoe-shaped main body is constructed from a resilient waterproof material that is configured to stretch to conform to a shape of an inserted shoe;

an upper opening that is disposed along a top end of the ankle section and is in communication with the hollow interior space;

a bottom opening that extends along an entire bottom periphery of each of the complementary shaped sides, the heel section and the toe section;

a fastener that is disposed along a back end of the main body, said fastener functioning to selectively engage the pair of complementary shaped sides and to transition the cover between an open position and a closed position;

a pair of inward facing ledges that are disposed along the bottom periphery of each of the complementary shaped sides, said ledges being configured to engage an outsole of a shoe positioned within the hollow interior space;

a toe ledge that is positioned beneath the toe section and is in communication with the pair of inward facing ledges, said toe ledge extending a distance inside the bottom opening between 2 and 5 times longer than the pair of inward facing ledges, said toe ledge and toe section forming a capped area for receiving and engaging a toe section of the shoe positioned within the hollow interior space; and wherein each of the toe ledge and the pair of inward facing ledges are constructed from an elastomeric and high friction material, and are configured to conform to a shape of the outsole of the shoe positioned within the hollow interior space.

2. The protective cover of claim 1, wherein the fastener includes opposing strips of hook and loop material that are secured onto a back end of the pair of complementary shaped sides.

3. The protective cover of claim 2, wherein the fastener extends between the heel section and the upper opening.

* * * * *